US006131525A

United States Patent [19]

Myers

[11] Patent Number: 6,131,525

[45] Date of Patent: Oct. 17, 2000

[54] WASTE OIL HEATING SYSTEM FOR WASHERS

[76] Inventor: John E. Myers, 2010 Kleppe La., Sparks, Nev. 89431

[21] Appl. No.: 09/183,320

[22] Filed: Oct. 30, 1998

[51] Int. Cl.[7] ..... F23G 5/00; F23G 5/12; F23G 5/46; F23G 7/05

[52] U.S. Cl. ..... 110/236; 110/233; 110/238; 134/105; 134/115 R

[58] Field of Search ..... 110/233, 236, 110/238, 346, 349; 134/18, 19, 32, 35, 40, 105, 106, 107, 115 R, 198

[56] References Cited

U.S. PATENT DOCUMENTS

| | | | |
|---|---|---|---|
| 3,693,951 | 9/1972 | Lawhon et al. | 110/236 X |
| 4,441,922 | 4/1984 | Most et al. | 110/236 X |
| 4,967,776 | 11/1990 | Folmar | 134/115 R X |
| 5,323,715 | 6/1994 | Fujiwara et al. | 110/238 |
| 5,398,708 | 3/1995 | Sheldon | 134/105 X |
| 5,511,570 | 4/1996 | Noren et al. | 134/105 |
| 5,529,080 | 6/1996 | Minkin | 134/107 X |
| 5,549,128 | 8/1996 | Mansur | 134/108 X |
| 5,642,742 | 7/1997 | Noren et al. | 134/108 X |
| 5,944,034 | 8/1999 | McRae et al. | 110/236 X |

FOREIGN PATENT DOCUMENTS

| | | | |
|---|---|---|---|
| 28 32 389 | 2/1980 | Germany | 110/238 |
| 58-92719 | 6/1983 | Japan | 110/238 |

*Primary Examiner*—Ira S. Lazarus
*Assistant Examiner*—Ljiljana V. Ciric
*Attorney, Agent, or Firm*—Theodore J. Bielen, Jr.

[57] ABSTRACT

A system for cleaning oil containing vehicular components with heated cleaning liquid comprising a washing unit having at least one spray nozzle for directing the cleaning liquid to the vehicular component. The system of the present invention also includes a reservoir for the cleaning liquid as well as a pump for supplying cleaning fluid to the liquid spray nozzle or nozzles. A heater in the form of a oil fired burner is utilized to pass heated exhaust gases through a heat exchange conduit which extends into the reservoir to impart heat to the cleaning liquid in the reservoir. The cooled exhaust gases are then exhausted through a stack. Oil is gathered from the vehicular component placed in a container which empties into a conduit to feed the oil fired burner to produce the hot exhaust gases.

10 Claims, 2 Drawing Sheets

WASTE OIL HEATING SYSTEM FOR WASHERS

BACKGROUND OF THE INVENTION

The present invention relates to a novel and useful system for cleaning oil containing vehicular components.

Many engine components such as transmissions, torque converters, and the like are refurbished in certain facilities. Such vehicular component rebuilding facilities are faced with an enormous task of disposing of lubricating oil, which are normally found within the used vehicular components. In the past, the cost and effort in disposing of such oil products has been quite expensive and has produced an notable impact on waste disposal facilities such as incinerators, chemical absorbers, and land fills.

A system which is capable of utilizing oil from the oil containing vehicular component as a portion of the rebuilding process would be a notable advance in the automotive arts.

SUMMARY OF THE INVENTION

In accordance with the present invention a novel and useful system for cleaning oil containing vehicular components is herein provided.

The system of the present invention utilizes a washing unit which includes at least one cleaning liquid spray nozzle. The washing unit also is provided with a support for the vehicular component such that it lies within the range of the spray nozzle for cleaning. Prior to rebuilding of the vehicular component, such as a torque converter, the parts to be rebuilt or refurbished are cleaned thoroughly.

The cleaning fluid may be water or other similar fluid and is generally found in a reservoir having a wall portion which possesses a vertical component. Delivery means supplies the cleaning liquid to the at least one cleaning liquid spray nozzle within the washer. Thus, it is convenient to place the reservoir beneath the washing unit in normal situations to recycle the cleaning fluid.

Heating means is also found in the present invention for elevating the temperature of the cleaning liquid in the reservoir. The heating means may take the form of a oil fired burner possessing a heated gas output. The fuel for the heating means conveniently, comprises the lubricating oil found in the vehicular component being washed in the washing unit. A heat exchange conduit extends into the reservoir from the heating means and is supported to the interior wall of the reservoir. Likewise, the heating means in the form of a oil fired burner, is supported to the wall of the reservoir. The heat exchange conduit includes a gaseous entrance portion and a gaseous exit portion. The heated gas output of the oil fired burner communicates with the gaseous entrance. An exit stack removes the cooled gases exiting the heat exchange conduit.

A container for the oil from the vehicular component is mounted to the top of the washing unit and includes a conduit for transporting oil to the oil fire burner mounted on the exterior wall of the reservoir. Thus, normally discarded oil from the vehicular component is employed to heat the cleaning liquid in the washing unit, which in turn, cleans the vehicular component itself.

It may be apparent that a novel and useful system for cleaning oil containing vehicular components with heated cleaning liquid has been provided.

It is therefore and object of the present invention to provide a system for cleaning oil containing vehicular components which utilizes the used oil in such component to heat a cleaning fluid used for washing the vehicular component.

Another object of the present invention is to provide a system for cleaning oil containing vehicular components which eliminates the need to dispose of oil within a used vehicular component through conventional methods of incineration and the like.

A further object of the present invention is to provide a system for cleaning oil containing vehicular components with heated cleaning liquid which is extremely efficient.

A further object of the present invention is to provide a system for cleaning oil containing vehicular components with heated cleaning liquid that saves time and money in the vehicular component rebuilding or refurbishing process.

Yet another object of the present invention is to provide a system for cleaning oil containing vehicular components with heated cleaning liquid that includes a unit that is compact and may be safely employed within a vehicular component rebuilding facility.

The invention possesses other objects and advantages especially as concerns particular characteristics and features thereof which will become apparent as the specification continues.

Figure 1:
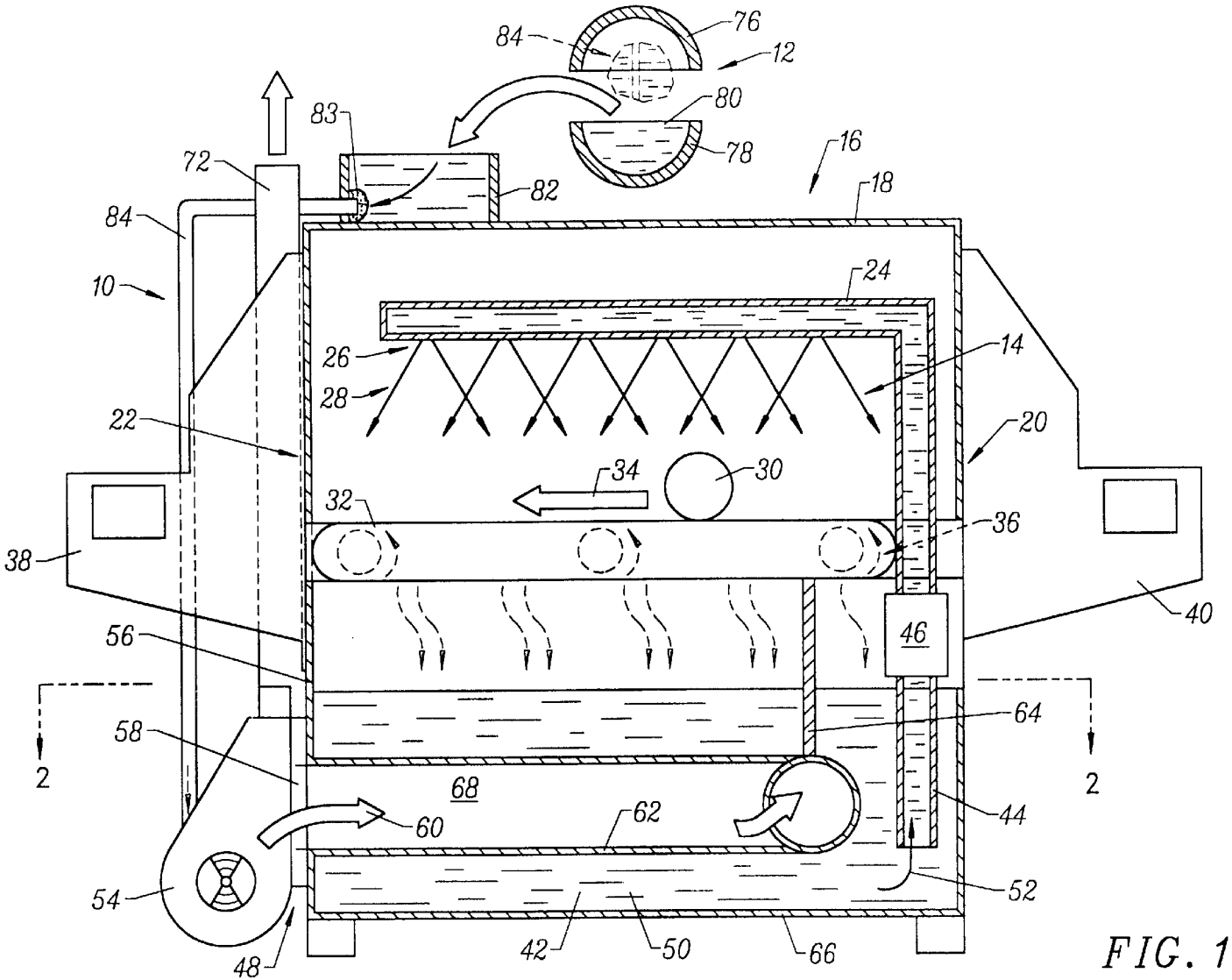
FIG. 1 is a side elevational view of the system of the present invention with the washing unit depicted in section and the vehicle component depicted in section and in an exploded configuration.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments which should be referenced to the prior described drawings.

The invention as a whole is depicted in the drawings by reference character 10. System 10 is employed to clean vehicular components such as torque converter 12, with heated cleaning liquid jets represented by plurality of arrows 14. Heated cleaning liquid is found within a washing unit 16 having a housing 18 with an entrance opening 20 and an exit opening 22. Such "pass-through" washing unit includes a stand pipe 24 having a sparger portion 26 with a plurality of washing nozzles 28. The vehicular unit 30, represented schematically, lies on a conveyor support 32 and moves according to directional arrow 34 to obtain the washing action from cleaning liquid jets 14. Multiplicity of rollers 36 are shown, in phantom, as representative of the conventional mechanism for moving conveyor support 32. Flanges 38 and 40 offer a degree of protection against excess cleaning fluid impacting the operator of washing unit 16. Reference is made to a multipurpose wash through conveyor washer sold under the designation PW-100 by Torque Converter Rebuilding Systems, Inc. of Sparks, Nevada, as representative of the portion of washing unit 16, hereinabove described.

The system of the present invention also includes a reservoir 42 which holds cleaning fluid, such as water, beneath conveyor support 32 and stand pipe 24. Stand pipe 24 includes a vertical section 44 which is capable of extending into reservoir 42 and directing cleaning liquid therefrom to nozzles 28 for creating washing jets 14. Pump 46 forces such cleaning liquid through stand pipe 24. It should be noted that cleaning liquid represented by cleaning liquid jets 14 travel from conveyor support 32 back down into reservoir 44 for recycling. Thus, the cleaning liquid within reservoir 42 may be continuously filtered or frequently changed, if system 10 is to be operated in a batch manner.

Figure 2:
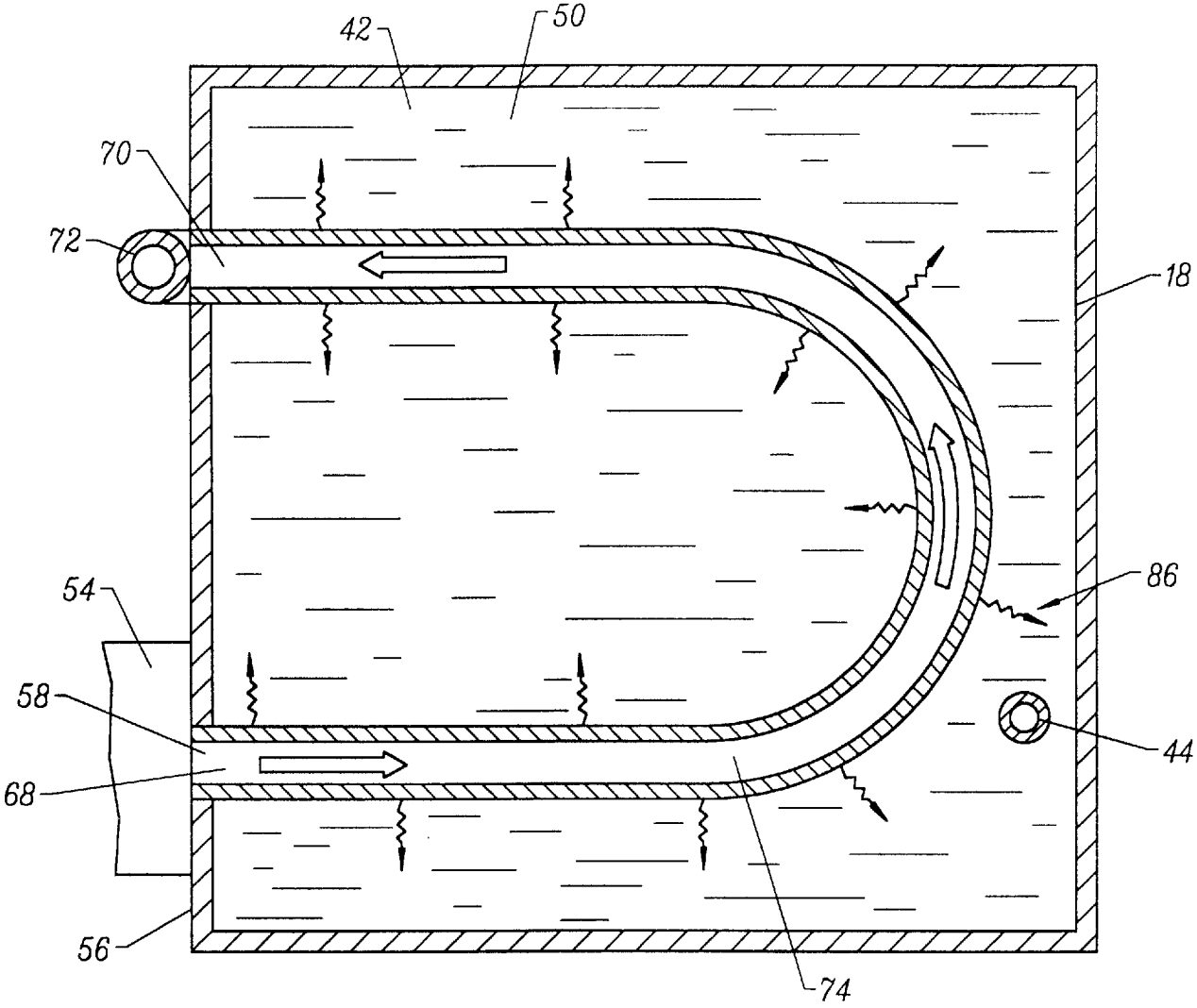
FIG. 2 is a sectional view taken along line 2—2 of FIG. 1 showing the heat exchange conduit within the liquid cleaning reservoir.

Heating means 48 is also illustrated on FIG. 1 and on FIG. 2. With respect to FIG. 1, heating means 48 is employed for elevating the temperature of the cleaning liquid 50 within reservoir 42. The cleaning liquid 50, which may be water and the like, is preferably heated prior to entering vertical section 44 of stand pipe 24, arrow 52. Such heating is accomplished by the use of oil fired burner 54 which is mounted to wall 56 of housing 18. Such mounting may take place by the use of fasteners, adhesives, welding, and other conventional means. For example, oil fired burner 54 may take the form of such as a CB-500 series oil burner manufactured by Clean Burn, Inc. of Leola, Pennsylvania. Burner 54 generates a heated gas output 58 indicated by directional arrow 60.

Referring to FIGS. 1 and 2, the heated gas output 58 of oil fired burner 54 passes into heat exchange conduit 62, which is generally horseshoe-shaped. Heat exchange conduit 62 is supported within reservoir 42 by a bar 64 which is welded to heat exchange conduit 62 and to the base of conveyor support 32. Of course, a multiplicity of bars such as bar 64 may be employed in this endeavor. Also, other supports, such as a plurality of collars around heat exchange conduit 62, may hold the same to the base 66 of housing 18. Heat exchange conduit 62 includes an gaseous entrance portion 68 and a gaseous exit portion 70. Gaseous entrance portion 68 of heat exchange conduit 62 communicates with the heated gas output 58 of burner 54, which may include a blower. Moreover, gaseous exit 70 of heat exchange conduit 62 communicates with an exit stack 72, to pass exit gases to the exterior of system 18. Heat exchange conduit 62 is manufactured of a material which very easily transfers heat from the interior portion 74 thereof to the reservoir of water 50. For example, metal, ceramic materials, and the like would suffice in this regard. Thus, cleaning liquid 50 within reservoir 42 is heated for creating cleaning liquid jets 14.

Most importantly, fuel for burner 54 is taken from a particular vehicular component part, such as torque converter 12, FIG. 1, which is depicted as being separated into two portions 76 and 78. Oil 80 within section 78 is poured into oil reservoir 82, via filter 83, and fed through conduit 84 to burner 54 for use. The torque converter parts 84 are depicted in phantom in FIG. 1 and are eventually passed into washing unit 16 represented by circle 30.

In operation, the user of system 10 removes oil 80 from vehicular part 12 and passes the same to reservoir 82. The vehicular component, such as the torque converter 12 depicted in FIG. 1, including the torque converter 12 internal parts 84, are then placed in washing unit 16 for cleaning. Oil 80 now found in reservoir 82 is passed through conduit 84 to burner 54. Burner 54 generates heat and includes a heated gas output 58 which passes into heat exchange conduit 62 either through natural convection or by the use of a blower found in burner 54. Gaseous entrance 68 of heat exchange conduit 62 leads the heated gas to heated gas exit 70 and through stack 72. Heat is passed from heat exchange conduit 62 to heat cleaning liquid 50 within reservoir 42, radiant arrows 86. Heated water passes through vertical section 44 of stand pipe 24, pump 46, and through plurality of nozzles 28 of sparger 26, in the form of cleaning liquid jets 14. The torque converter 12 and its internal component parts 84 is represented by circle 30 within washing unit 16. These items are cleaned by washing unit 16 and the heated water emanating from sparger 26. Thus, the employment of system 10 obviates the need to dispose of waste oil 80 from vehicular parts 12, generates heated cleaning fluid and cleans vehicular parts 12 and the components 84 therewithin, efficiently and cheaply.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A system for cleaning oil-containing vehicular components with heated cleaning liquid, comprising;

a. a washing unit including at least one cleaning liquid spray nozzle and a support for the vehicular components within the range of said liquid spray nozzle;

b. a reservoir for the cleaning liquid, said reservoir including a wall and delivery means for supplying cleaning liquid to said at least one cleaning liquid spray nozzle;

c. heating means for elevating the temperature of the cleaning liquid in said reservoir, said heating means comprising an oil-fired burner possessing a heated gas output, a heat exchange conduit extending into said reservoir to impart heat to the cleaning liquid therein, said heat exchange conduit including a gaseous entrance portion and a gaseous exit portion, said gaseous entrance portion communicating with said heated gas output of said heat exchange conduit;

d. an exit gas stack communicating with said gaseous exit portion of said oil-fired burner;

e. a container for oil retrieval from the vehicular components; and f. means for transporting oil, from said container for oil from the vehicular components, to said oil-fired burner for combustion therein.

2. The system of claim 1 in which said container for oil from the vehicular component includes means for mounting said container on said washing unit.

3. The system of claim 1 which further comprises a filter for cleaning the oil from the vehicular component prior to combustion by said oil fired burner.

4. The system of claim 1 in which said heat exchange conduit is a curved member, said gaseous entrance portion and said gaseous exit portion being adjacent said wall of said reservoir.

5. The system of claim 4 in which said oil fired burner further comprises means for fixing said oil fired burner to said wall of said reservoir.

6. The system of claim 1 in which said container for oil includes supporting means for positioning said container to said washing unit.

7. The system of claim 6 in which said container for oil from the vehicular component includes means for mounting said container on said washing unit.

8. The system of claim 6 which further comprises a filter for cleaning the oil from the vehicular component prior to combustion by said oil fired burner.

9. The system of claim 6 in which said heat exchange conduit is a curved member, said gaseous entrance portion and said gaseous exit portion being adjacent said wall of said reservoir.

10. The system of claim 9 in which said oil fired burner further comprises means for fixing said oil fired burner to said wall of said reservoir.

* * * * *